United States Patent [19]

Hashimoto et al.

[11] Patent Number: 4,783,375

[45] Date of Patent: Nov. 8, 1988

[54] HEAT-SENSITIVE RECORDING MATERIAL

[75] Inventors: Ken Hashimoto; Torigoe, Nobuyuki, both of Kanagawa, Japan

[73] Assignee: Fuji Xerox Co., Ltd., Tokyo, Japan

[21] Appl. No.: 884,581

[22] Filed: Jul. 11, 1986

Related U.S. Application Data

[63] Continuation-in-part of Ser. No. 855,283, Apr. 24, 1986.

[30] Foreign Application Priority Data

Jul. 11, 1985 [JP] Japan ..... 60-151231
Jul. 11, 1985 [JP] Japan ..... 60-151232

[51] Int. Cl.[4] ..... B41M 5/26

[52] U.S. Cl. ..... 428/480; 428/195; 428/913; 428/914

[58] Field of Search ..... 428/195, 207, 913, 914, 428/480

[56] References Cited

U.S. PATENT DOCUMENTS

| | | | |
|---|---|---|---|
| 3,941,596 | 3/1976 | Heiart | 156/234 |
| 4,392,905 | 7/1983 | Boyd et al. | 428/914 |
| 4,474,859 | 10/1984 | Oshima | 428/211 |
| 4,511,602 | 4/1985 | Margerum et al. | 427/148 |

FOREIGN PATENT DOCUMENTS

| | | | |
|---|---|---|---|
| A10033464 | 8/1981 | European Pat. Off. | 346/227 |
| 0098357 | 1/1984 | European Pat. Off. | 346/227 |
| A10098357 | 1/1984 | European Pat. Off. | 428/913 |
| A10097493 | 1/1984 | European Pat. Off. | 346/227 |
| A2C137741 | 4/1985 | European Pat. Off. | 346/227 |
| 993141 | 5/1965 | United Kingdom | 428/913 |
| 2010515A | 6/1979 | United Kingdom | 346/227 |
| 2010515 | 6/1979 | United Kingdom | 428/913 |
| 2069159 | 8/1981 | United Kingdom | 503/204 |
| 2150310 | 6/1985 | United Kingdom | 428/484 |
| A2161824 | 1/1986 | United Kingdom | 503/227 |

*Primary Examiner*—Bruce H. Hess
*Attorney, Agent, or Firm*—Sughrue, Mion, Zinn, Macpeak, and Seas

[57] ABSTRACT

A heat-sensitive recording material is disclosed, comprising a support having provided thereon a hot-melt heat-sensitive ink material layer, wherein said heat-sensitive ink material comprises an amorphous polyester having a glass transition temperature of not less than 40° C. and a number average molecular weight of not more than 10,000 and a coloring material as main components and a releasing agent as an optional but rather preferred component. The recording material is excellent in color reproducibility, resolving power, recording sensitivity, transfer properties and fixing properties.

15 Claims, No Drawings

HEAT-SENSITIVE RECORDING MATERIAL

CROSS-REFERENCE TO RELATED APPLICATION

This is a continuation-in-part application of an earier application Ser. No. 855,283 filed Apr. 24, 1986, entitled "HEAT-SENSITIVE RECORDING MATERIAL".

FIELD OF THE INVENTION

This invention relates to an image recording material with which heat-sensitive transfer recording is effected upon heating correspondingly to signals applied by means of a thermal head, a laser beam or flash light, or by directly passing electric signals.

BACKGROUND OF THE INVENTION

A number of heat-sensitive recording systems have hitherto been proposed, in which changes of materials in physical properties or chemical reactivity induced by heat energy are utilized. Inter alia, extensive studies have recently been directed to improvements in heat-sensitive color forming recording systems utilizing color forming reaction between leuco dyes, e.g., Crystal Violet Lactone, fluoran compounds, spiropyran compounds, etc., and phenolic compounds, e.g., bisphenol A, or other organic or inorganic acids, or thermal reaction between organic acid metal salts and organic reducing agents, e.g., phenols, metal sulfides, organic chelating agents or organic sulfur compounds; and heat-sensitive transfer recording systems utilizing thermal change of physical properties of the materials, such as heat melting property, heat sublimation property, etc., to transfer inks or coloring materials to a material on which a record is made, e.g., paper.

In particular, the latter heat-sensitive transfer recording system has been applied to printers, facsimiles, copying machines, and the like because of their advantages, such as possibility of recording on paper, satisfactory light-fastness, stability and preservability of a recorded image, high reliability attributed to a simple recording mechanism, and the like.

However, the system in which dyes are sublimed by heat has problems in terms of recording sensitivity, preservation stability of the recording material, fixing stability and light-fastness of the recorded image, and so on, although it enables reproduction of continuous gradation. According to the system in which inks are heat-melted according to signals given and transferred to paper, etc., the above problems can be somewhat solved. However, since this system usually employs a crystalline wax having a low melting point as a binder of a heat-sensitive ink layer, diffusion of heat in the recording material results in reduced resolving power or reduced intensity of a transferred and fixed image. Moreover, crystalline waxes have defect in that it is difficult to obtain clear images due to light scattering in the crystalline phase.

More specifically, in order to obtain a clear color image, especially a pictorial image in full color, by printing of ink materials one after another, magenta, yellow and cyan ink materials are generally used, and each of these ink materials is printed in layers to form a mixed color composed of two of them (hereafter referred to as "2-color (cyan, magenta, yellow)") or a mixed color composed of the three ink materials (hereafter referred to as "3-color (cyan, magenta, yellow)"). For instance, in obtaining a 2-color (cyan, magenta, yellow) by printing two kinds of the ink materials in layers, a color difference between the intended color and the 2-color (cyan, magenta, yellow) actually obtained depends on the transparency of the ink materials used. In this case, if at least the ink material, or a binder layer in a strict sense, that is printed as an upper layer has satisfactory transparency, reflected light from the whole ink layer approximates to that of the 2-color (cyan, magenta, yellow) attributed to the characteristics of the pigments per se, to therby achieve satisfactory color reproducibility.

It is known to use resins as binder components of a heat-sensitive ink layer, as disclosed in Japanese Patent Application (OPI) Nos. 87234/79 and 98269/81, etc. (the term "OPI" as herein used means "unexamined published application"). However, unlike the above-described waxes which are used as the binders for the heat-sensitive ink materials, these resins are used for improving ink fixing property or durability. There is no technical disclosure in these publications with respect to the transparency of the binder components for the purpose of color reproduction.

SUMMARY OF THE INVENTION

Accordingly, an object of this invention is to provide a heat-sensitive transfer recording material which enables clear color reproduction.

Another object of this invention is to provide a heat-sensitive transfer recording material having satisfactory resolving power.

A further object of this invention is to provide a heat-sensitive transfer recording material having satisfactory recording sensitivity and transfer and fixing properties.

As a result of extensive and intensive investigations, it has now been found that the above objects of this invention can be accomplished by altering a binder for heat-sensitive ink materials from a conventional crystalline wax-based binder to a substantially amorphous transparent polyester. It has further been found that addition of a small amount of a releasing agent to the heat-sensitive ink material further improves recording sensitivity, image quality and, in particular, resolving power. The present invention has been completed based on these findings.

The present invention relates to a heat-sensitive recording material comprising a support having provided thereon a hot-melt heat-sensitive ink material layer, wherein said heat-sensitive ink material comprises an amorphous polyester having a glass transition temperature of not less than 40° C. and a number average molecular weight of not more than 10,000 and a coloring material as main components and a releasing agent as an optional but rather preferred component.

DETAILED DESCRIPTION OF THE INVENTION

The amorphous polyester which can be used in the present invention is a substantially amorphous transparent polymer which does not essentially show a clear melting point unlike crystalline polyesters, e.g., polyethylene terephthalate, which have conventionally been used as a support for heat-sensitive recording materials.

Waxes conventionally employed as binder for the heat-sensitive ink material include paraffin wax, carnauba wax, montan wax, beeswax, Japan wax, candelilla wax, low-molecular weight polyethylene, α-olefin oligomers and copolymers or modified products of these waxes. The binder is mixed and dispersed with dyes, pigments, etc. together with, if necessary, a mineral oil, e.g., spindle oil, a vegetable oil, e.g., linseed oil, tung oil, etc., a plasticizer, e.g., dioctyl phthalate and dibutyl phthalate, a higher fatty acid, e.g., oleic acid and stearic acid, or metal salts, amide or other derivatives thereof, and the like. The resulting mixture is then coated on a thin plastic film or condenser paper to produce a heat-sensitive transfer recording material.

Since the above-mentioned waxes are crystalline, they have relatively clear melting points in a temperature range of from about 50° C. to about 150° C. and undergo steep change from a solid phase to a liquid phase upon heating to their melting point or higher temperatures, finally to a low-viscosity liquid of about $10^{-2}$ to about 10 poises at temperatures higher than the melting point by about 30° C. To the contrary, amorphous polyesters do not essentially have melting points and gradually change from a solid phase into a liquid phase across the border of a glass transition temperature (Tg) when heated. The viscosity change during this phase transition basically follows the WLF or Andrade's viscosity formula, and, in general, the viscosity decreases only to about $10^3$ to $10^5$ poises at the lowest even at a temperature higher than Tg by about 50° C. In the case of heat-sensitive transfer recording, the transfer and fixing sensitivity are basically governed by melt viscosity or melt viscoelasticity of the binder used. Therefore, it is considered that use of amorphous polymers as a binder of heat-sensitive ink materials is disadvantageous from the standpoint of sensitivity. Nevertheless, it has surprisingly been found that image quality and image stability can be markedly improved without impairing sensitivity by using an amorphous polyester having a specific molecular weight and a specific glass transition temperature and, if desired, a releasing agent in combination.

The amorphous polyesters inclusive of oligomers which can be used in the present invention have a number average molecular weight ($\overline{M}n$) of not more than about 10,000, and preferably about 5,000 or less, as determined by gel permeation chromatography (calculated as polystyrene) and a glass transition temperature (Tg) of not less than about 40° C., and preferably of from about 50° to 80° C., as determined by differential scanning calorimetry (DSC).

If the amorphous polyester has a Tg of lower than 40° C., the resulting heat-sensitive ink material is liable to cause blocking and comes to lack stability during preservation or on use. On the other hand, when the Tg exceeds 80° C., the heat-sensitive ink material exhibits satisfactory heat stability but have a reduced sensitivity and are used only for special applications. Even if the Tg falls within the above range, it was experimentally confirmed that sensitivity is reduced when the molecular weight of the amorphous polyester is too high. This reduction in sensitivity is assumed ascribable to intermolecular cohesive force due to entanglement of molecular chains. It was also confirmed that satisfactory transfer and fixing properties can be obtained with number average molecular weights of not more than about 10,000.

A weight average molecular weight ($\overline{M}w$) of the amorphous polyester can be set depending on utility of the recording material. In the case of obtaining a binary transfer image (i.e., mono tone image), it is desirable, as in the case of the conventional wax type inks, to make molecular weight distribution narrow by setting a weight average molecular weight not to exceed about 40,000, and preferably not to exceed about 10,000, to thereby make the softening characteristics of the amorphous polymer sharply changed within a certain temperature range. On the other hand, when it is intended to obtain continuous gradation, to from a transfer images having more than two tones, or to repeatedly use the recording material, it is desirable to use an amorphous polyester having softening characteristics gradually changed in accordance with applied energy. In the case, the weight average molecular weight of the amorphous polyester is not necessarily required to be small and may be set at about 40,000 or more. Even using such an amorphous polyester, however, a binary transfer image can also be obtained. A molecular weight distribution is not always required to have a single peak and may have a plurality of molecular weight peaks. Crosslinked or branched polymers may also be used in combination.

The amorphous polyester used in the present invention may be prepared by polycondensation of saturated or unsaturated dibasic acids (e.g. phthalic acid, phthalic anhydride, isophthalc acid, terephthalic acid, hexahydrophthalic anhydride, malonic acid, succinic acid, glutaric acid, adipic acid, sebacic acid, maleic anhydride, fumaric acid, itaconic acid and tetrahydrophthalic anhydride) or a dimer acid (dimered linoleic acid) with dihydric alcohols such as ethylene glycol, 1,2-propylene glycol, 1,6-hexanediol, and bisphenol compounds and addition products thereof with propylene oxides or ethylene oxide. Trifunctional compounds (e.g. trimellitic acid, glycerin and trimethylolpropane) may be additionally used to prepare branched or crosslinked polyesters.

Preferred examples of the bisphenol compound used as the dihydric alcohol component are listed below:

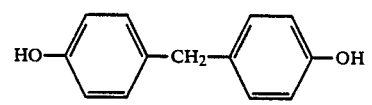

(1)

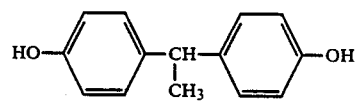

(2)

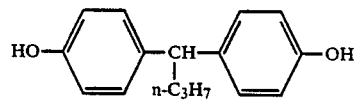

(3)

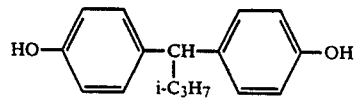

(4)

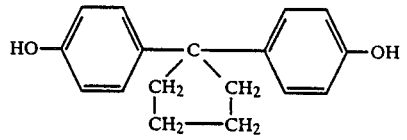

(5)

-continued (6)

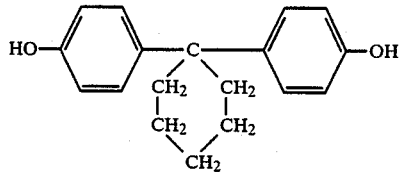

(7)

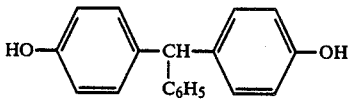

(8)

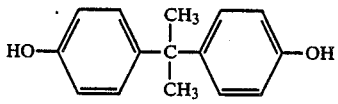

(9)

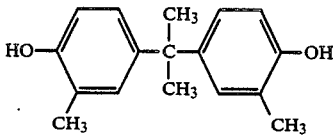

(10)

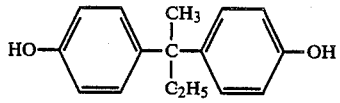

(11)

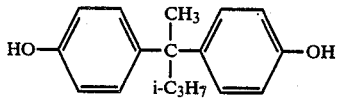

(12)

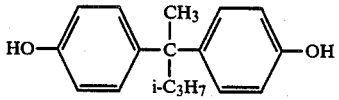

(13)

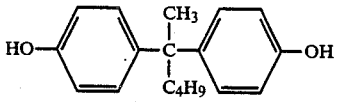

(14)

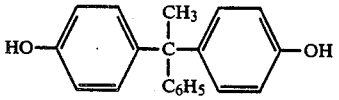

(15)

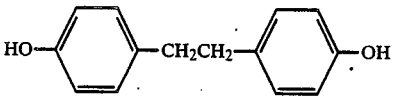

Of the amorphous polyesters, aromatic polyesters having bisphenolic components in the main chain have the advantage that their glass transition temperatures can be controlled to lie within the aforementioned range if their number average molecular weights are limited to 10,000 or below. Therefore, such aromatic polyesters are used with particular advantage as the binder in the present invention. In the case, the bisphenolic component is preferably contained in an amount of at least 30 mol%, more preferably 30 to 50 mol% based on the total amount of the dihydric alcohol component, whereby an aromatic polyester having good flexibility at room temperature can be obtained. For the purpose, an ether compound obtained by dehydration reaction of a bisphenol compound (e.g., bisphenol A) and a straight chain diol (e.g., ethylene glycol and propylene glycol) is particularly preferably used as the dihydric alcohol component.

The acid and hydroxyl values of the amorphous polyester are not limited to any particular values but those having acid and hydroxyl values not higher than about 60 are generally easy to use.

The polyester usually has both —COOH and —OH group at the terminals of the molecular chain. The amorphous polyesters of this invention may be used in the form of modified polyesters or block or graft copolymers containing the polyesters, which are made by subjecting the polyester to condensation, ionic reaction, polymerization reaction or any other reactions that utlize these terminal functional groups. In the case of unsaturated polyesters, they may be used as binder materials after modifying or converting to polyester-containing graft copolymers by making use of the double bonds in the molecule.

For instance, the amorphous polyester may be modified by reacting an aliphatic acid (e.g. stearic acid) or a higher alcohol (e.g. stearyl alcohol) with the terminal —COOH and —OH groups, or by reacting the polyester with an isocyanate or an amine, or by reacting the polyester with a silicone compound, an epoxy compound or a phenol compound. Alternatively, the polyester may be further condensed with a predominantly crystalline aliphatic polyester to form a block copolyester, or a polyester-containing graft copolymer may be prepared by polymerizing one or more vinyl monomers selected from styrenes (e.g. styrene and α-methylstyrene), methacrylic acid esters (e.g. methyl methacrylate) and acrylic acid esters (e.g. butyl acrylate) in the presence of the polyester utilizing the double bonds in the molecular chain. If desired, ionic crosslinks may be formed with the terminal caboxylic acids by addition of zinc acetate, zinc oxide, etc.

The binder used in the present invention will attain the intended effect satisfactorily even if it is solely made of one or more of the polyesters described above but, if desired, other polymers and additives may be incorporated in the binder.

Illustrative polymers that may be additonally incorporated include: homo- and copolymers of styrene and derivatives or substituted forms thereof such as styrene, vinyltoluene, α-methylstyrene, 2-methylstyrene, chlorostyrene, vinylbenzoic acid, soidum vinylbenzenesolfonate and aminostyrene; homopolymers of methacrylic acid esters (e.g. methyl methacrylate, ethyl methacrylate, butyl methacrylate and hydroxyethyl methacrylate) and methacrylic acid, acrylic acid esters (e.g. methyl acrylate, ethyl acrylate, butyl acrylate and 2-ethylhexyl acrylate) and acrylic acid, dienes (e.g. butadiene and isoprene), and vinyl monomers (e.g. acrylonitrile, vinyl ethers, maleic acid and esters thereof, maleic anhydride, cinnamic acid, vinyl chloride and vinyl acetate); and copolymers of these monomers with other monomers. Needless to say, the vinyl resins shown above may be used in the form of crosslinked polymers by using polyfunctional monomers such as divinylbenzene. Other usable polymers include plycarbonates, polyamides, epoxy resins, polyurethanes, silicone resins, fluorine resins, phenolic resins, terpene resins, petroleum resins, hydrogenated petroleum resins, alkyd resins, ketone resins and cellulose derivatives. If these polymers and oligomers are used in the form of copolymers, an appropriate mode of copolymerization may be selected (e.g. random copolymerization, alternating copoly-merization, graft copolymerization, block copolymerization or interpenetration copolymerization) depending upon the intended use. Two or more polymers or oligomers may be used after being mixed by mechanical means (e.g. fusion mixing, solution mixing and emulsion mixing); alternatively, mixing may be effected by performing coexisting polymerization, multi-step polymerization, etc. on the components of the specific polymer or oligomer.

The releasing agent which can be used as a binder component in combination with the above-described amorphous polyester is an organic substance or an organic or inorganic low-molecular polymer which is solid at room temperature, whose melting point as measured by DSC or softening point as measured by a ring and ball method ranges from 50° to 200° C., and preferably from 60° to 150° C., and which abruptly becomes a low-viscosity liquid at a temperature exceeding the melting point or softening point because of its relatively low surface energy. When the melting point or softening point is lower than 50° C., the heat-sensitive ink material has insufficient stability during preservation or on use. With melting points exceeding 200° C., addition of such a substance does not exhibit substantial effects when heat energy is applied in accordance with a general heat-sensitive recording system.

In the present invention, preferred examples of the releasing agents include those having such a low viscosity that the melt viscosity suddenly decreases to about 10 poises or less, and more preferably to about 1 poise or less in a temperature range of from about 100° to 180° C. and/ or such a low surface energy as having a critical surface tension of about 40 dyn/cm or less, and more preferably about 30 dyn/cm or less.

Specific examples of such releasing agents are higher fatty acids, e.g, palmitic acid, stearic acid, etc., and derivatives thereof such as metal salts (e.g., zinc stearate), esters or partially saponified products thereof, amides, etc.; higher alcohols; polyhydric alcohol derivatives, such as esters; waxes, e.g., paraffin wax, carnauba wax, montan wax, beeswax, Japan wax, candelilla wax, etc.; polyolefins having a viscosity average molecular weight of from about 1,000 to 10,000, e.g., low-molecular weight polyethylene, polypropylne or polybutylene, etc.; low-molecular weight copolymers of olefins or α-olefins and organic acids (e.g., maleic anhydride, acrylic acid, methacrylic acid, etc.) or vinyl acetate, etc.; low-molecular weight polyolefin oxides; halogenated polyolefins; homopolymers of methacrylic esters or acrylic esters having a long-chain alkyl side chain (e.g., lauryl methacrylate, stearyl methacrylate, etc.) or acrylic esters or methacrylic esters having a perfluoro group, or copolymers thereof with vinyl monomers (e.g., styrenes); low-molecular weight silicone resins, such as polydimethylsiloxane, polydiphenylsiloxane, etc., and silicone-modified organic substances; cationic surface active agents such as ammonium salts or pyridinium salts having a long-chain aliphatic group; anionic or nonionic surface active agents having a long-chain aliphatic group or perfluoro surface active agents; and the like. Of these, fatty acid amides, 12-hydroxystearic acid and oleic acid monoglyceride are preferred. These releasing agents may be used individually or in combination of two or more thereof.

These releasing agents are melted upon heating to lower excessive cohesive force or adhesive force among molecules of the amorphous polyester, which is a main binder component, and/or between the amorphous polyester and a support due to their low cohesive force and/or low surface energy. As a result, recording can be achieved with lower energy, and recording sensitivity and image quality, in particular, resolving power can be improved.

Since many of the releasing agents are crystalline, addition in excess causes light scattering due to crystals, which leads to reduction in transparency and, in turn, deterioration in color reproducibility. Further, the releasing agent, when added in excess, causes reduction of ink fixing property onto materials, such as paper, and also reduction in resolving power, which results in an enlarged image. To the contrary, if the amount of the releasing agents is too small, their function cannot be exerted effectively. Accordingly, the volume ratio of the amorphous polyester to the releasing agent in the heat-sensitive ink material preferably ranges from about 70/30 to about 99/1, and more preferably from about 80/20 to about 95/5. Within the above-recited range, the heat-sensitive ink material according to the present invention can achieve its object in the most effective way without deteriorating color reproducibility. Heat-sensitive ink materials containing less than 70% by volume of the amorphous polyester based on the total volume of the binder components (solid components) may be of practical use, but the resulting image quality tends to be degraded.

If the thermal recording material of the present invention is used for the purpose of reproducing pictorial full colors, special care must be exercised to ensure that the polyester is miscible with the releasing agent. Poor color reproduction will result if: the miscibility or dispersibility of the two substances is low; the refractive index of the polyester differs greatly from that of the release substance; or the releasing agent is crystalline and comprises large crystal grains.

In order to avoid these problems, active groups such as —COOH, —OH and unsaturated bonds present at the terminal ends or in side chains in the polyester may be caused to interact with active groups in the releasing agent so as to promote the formation of a uniform dispersion or mixture of the two substances. If desired, the active groups in the two substances may be allowed to react with each other to a greater extend so as to improve the sensitivity and transparency of the ink material while reducing the uneveness of its sensitivity.

Alternatively, coexisting condensation polymerization of coexisting synthesis of the polyester or other binding resinous substances may be performed in the presence of the releasing agent, and this method is effective for preparing a fine dispersion of the two substances or a gaft copolymer thereof.

If a crystalline releasing agent is dispersed in the binder resin, the size of the crystal grains is preferably not larger than one half of the wavelength of visible light (i.e., ≦0.3 microns), with diameters not larger than 0.2 microns being particularly preferable.

The heat-sensitive recording material in accordance with the present invention may further contain waxes, oils, liquid plasticizers and any other additives that are used in conventional thermal ink materials for thermal recording. Other additives that may be provided within or in proximity to the heat-sensitive ink material of the present invention include: homo- or copolymers of olefins such as ethylene and propylene; olefinic copolymers with organic acid grafts; chlorinated paraffins;

small molecular urethane compounds; plastizers which are solid at ambient temperature; charge control and/or preventing agents such as surfactants; agents that impart electrical conductivity; antioxidants; agents that impart improved heat conductivity; magnetic substances; ferroelectric substances; preservatives; flavors; anti-blocking agents; reinforcing fillers; foaming agent; substances capable of sublimation; and infrared absorbers. However it is preferred that the amount of these additives be within such a range that the above-described amorphous polyester occupies at least 50% by volume, and preferably 70% by volume or more, based on the total volume of binder components.

The coloring material which can be used in the present invention includes dyes and pigments conventionally known for printing inks or other coloring purposes, such as black dyes and pigments, e.g., carbon black, oil black, graphite, etc.; acetoacetic acid arylamide type monoazo yellow pigments (First Yellow type), e.g., C.I. Pigment Yellow 1, 3, 74, 97 or 98, etc.; acetoacetic acid arylamide type disazo yellow pigments, e.g., C.I. Pigment Yellow 12, 13 or 14, etc.; yellow dyes, e.g., C.I. Solvent Yellow 19, 77 or 79, C.I. Disperse Yellow 164, etc.; red or deep red pigments, e.g., C.I. Pigment Red 48, 49:1, 53:1, 57:1, 81, 122 or 5, etc.; red dyes, e.g. C.I. Solvent Red 52, 58 or 8 etc.; blue dyes and pigments, such as copper phthalocyanine or its derivatives or modified compounds, e.g., C.I. Pigment Blue 15:3, etc.; and colored or colorless subliming dyes.

These coloring materials may be used alone or in combination of two or more thereof. It is possible, of course, to mix them with extender pigments or white pigments for controlling color tone. In order to improve dispersing property of these coloring materials in the binder component(s), they may be treated with surface active agents, coupling agents, such as silane coupling agents, or polymers, or polymeric dyes or polymeric graft pigments may be employed.

The heat-sensitive transfer recording materials of the present invention can be obtained by coating the heat-sensitive ink material comprising the amorphous polyester, the coloring material and, if desired, the releasing agent and the aforesaid additives on a support.

The heat-sensitive ink material can be prepared by dissolving or dispersing the binder component(s) in a solvent or a dispersing medium capable of stably dispersing it (them) to form a solution or a dispersion and mixing with other components in a mixer, e.g., a ball mill, a sand mill, attritor, a three-roll mill, etc.

The components may be melt-mixed in a hot three-roll mill, a hot press kneader, a Banbury mixer, etc.

The heat-sensitive ink material may also be prepared by polymerizing a monomer or monomers for the amorphous polymer, that is the main binder component, in the presence of the coloring material, the releasing agent, the additives, and the like.

The thus prepared heat-sensitive ink material is then coated on a support by solution coating or hot melt coating using a gravure coater, a wire bar, etc.

The heat-sensitive ink material may also be coated on a support by powder coating which comprises powderizing the ink material by spray-drying, grinding, and the like and then coating the powder by electrostatic powder coating, and the like. In this case, the coated powder may be subjected, if desired, to heat treatment, press treatment, solvent treatment or the like to thereby fix the powder ink on the support.

Supports which can be advantageously used to include plastic films of polyesters (e.g., polyethylene terephthalate), polyimides, imide type copolymers, fluorine-containing polymers, polypropylene, etc.; thin sheets of films, such as condenser paper. These sheets, films or rolls may contain therein thermal property-improving agents for improving thermal conductivity, thermal stability, etc., parting agents, antistatic agents, electrical conductors, reinforcing materials, and the like.

The supports must be electrically resistant when used with the addition of electrical conductors such as carbon black, metal powders, etc. Such supports generate heat upon the application of electric power. The electrical conductor is preferably added in an amount of 10 to 40% by weight based on the weight of binder constituting the support which exhibits a certain electrical resistance with the electrical conductor, such as polyimide resins, polycarbonate resins. In the case using the heat-sensitive recording material having the electrically resistant support, the recording can be effected by contacting an electrode (e.g., one consisting of manyl needle-like electrodes corresponding to density of picture element) with the surface of the electrically resistant support opposite to the ink material layer which is in contact with an image-receiving material such as paper, applying voltage to the electrode, whereby the support generates heat at which the electric current is applied, and transferring the ink material only at the heated areas onto the image-receiving material. For the image formation, the electrodes may be a single electrode in combination with a return-electrode layer, a power-supply electrode in combination with a return-electrode, and the like.

For recording by means of a thermal head, etc., heat resistant, running properties, and the like of the support can be improved by providing a layer containing silicon compounds, fluorine-containing compounds, a resin layer, a crosslinked polymer layer, a metal layer, a ceramic layer, or the like on the side which contacts with a thermal head.

The aforesaid additives for the support may be incorporated into an outer layer. In particular, it is preferred that a layer of a parting agent such as low molecular weight polymers and wax is provided between the support and the ink material layer. The support may have a smooth surface or a roughened or grooved surface, or may be porous. In addition, a thermo-electric transducing element or a photothermal transducing element having a structure analogous to a thermal head may be directly used as a support on which a heat-sensitive ink material layer is provided.

The thickness of the support is appropriately selected depending on use and is usually from about 1 to about 200 microns in view of easiness on use. For improving resolving power, a preferred thickness of the support is from about 1 to about 10 microns. The thickness of the heat-sensitive ink layer is selected from about 0.5 to about 50 microns depending on use and is usually selected from about 1 to about 20 microns in view of easiness in use. An intermediate layer that controls adhesion may be provided between the heat-sensitive ink material layer and the support. Plural kinds of heat-sensitive ink materials having different physical properties may be coated on the support in layer to form a multilayer construction or may be coated on the same plane in divided areas.

The thus prepared heat-sensitive recording material is heated according to applied signals by means of a thermal head, a laser beam or flash light or by directly passing electric signals, whereby the heat-sensitive ink material is transferred to materials on which recording is to be made, such as paper, films, etc., either in contact or not in contact with the recording material. For example, the back surface of the heat-sensitive recording material (i.e., an electrically insulating support surface opposite to the ink material layer) is brought into contact with a thermal head consisting of many fine heat-generating resistors (corresponding to density of picture element) and an electrical energy is applied to the resistors to partially heat the ink material layer, whereby the ink material is transferred only at the heated areas to an image-receiving material which is faced with the ink material layer. It is possible to improve recording properties with the aid of mechanical forces, such as pressure and foaming, as well as electrical field, magnetic field, ultrasonic waves, solvents, and the like.

This invention will now be illustrated in greater detail with reference to the following examples, but it should be understood that they are intended to limit the present invention. In these examples, all the parts and ratios are given by weight unless otherwise indicated.

COMPARATIVE EXAMPLE 1

The components listed below were fused at 100° C. and kneaded on a three-roll mill to formulate a heat-sensitive ink material:

| | |
|---|---|
| Paraffin wax (m.p. = 69° C.) | 85 parts |
| Flexibility providing agent (spindle oil) | 5 parts |
| Colorant (one of the three pigments listed below: | 10 parts |
| C.I. Pigment Blue 15:3 for cyan ink; C.I. Pigment Red 57:1 for magenta ink; C.I. Pigment Yellow 12 for yellow ink) | |

Each of the prepared heat-sensitive ink materials of three colors was coated with a wire bar onto a polyimide film (7.5 microns thick) placed on a hot plate (110° C.) to form a thermal recording material with a heat-sensitive layer having a dry thickness of 2.5 microns.

COMPARATIVE EXAMPLE 2

Using the same colorants as employed in Comparative Example 1, heat-sensitive ink materials of cyan, magenta and yellow colors were prepared by kneading the following formulation in a ball mill for 40 hours at ambient temperature.

| | |
|---|---|
| Aromatic polyester resin ($\overline{M}n$: about 18,000; $\overline{M}w$: about 300,000; Tg: about 84° C.; principally composed of terephthalic acid and the reaction product (ether compound) of bisphenol A and ethylene glycol (bisphenol A/ethylene glycol: 1/2 by mol); terephthalic acid/the reaction product: 1/1 by mol; and acid value; about 18) | 18 parts |
| Colorant (same a in Comp. Ex. 1) | 2 parts |
| Methyl ethyl ketone | 40 parts |
| Toluene | 40 parts |

Each of the thus prepared heat-sensitive ink materials of three colors was applied with a wire-bar coater onto a polyimide film (7.5 microns thick) to form a themal recording material with a heat-sensitive layer having a dry thickness of 2.5 microns.

COMPARATIVE EXAMPLE 3

The same procedure as in Comparative Example 2 was repeated except that the amount of the aromatic polyester resin was changed to 16 parts and 2 parts of 12-hydroxystearic acid (m.p. 75° C.) was further added, whereby three thermal recording material were formed.

EXAMPLE 1

Using the same colorants as employed in Comparative Example 1, heat-sensitive ink materials of cyan, magenta and yellow colors were prepared by kneading the following formulation in a ball mill for 40 hours at ambient temperature.

| | |
|---|---|
| Aromatic polyester resin ($\overline{M}n$: about 2,500; $\overline{M}w$: about 10,000; Tg: about 50° C.; primarily composed of fumaric acid and the reaction product of bisphenol A and propylene glycol (bisphenol A/propylene glycol: 1/2 by mol); fumaric acid/the reaction product: 1/1 by mol; and acid value; about 20) | 18 parts |
| Colorant (same as in Comp. Ex. 1) | 2 parts |
| Methyl ethyl ketone | 40 parts |
| Toluene | 40 parts |

As in Comparative Example 2, each of the prepared heat-sensitive ink materials of three colors was applied with a wire-bar coater onto a polyimide film (7.5 microns thick) to form a thermal recording material with a heat-sensitive layer having a dry thickness of 2.5 microns.

EXAMPLE 2

The same procedure as in Example 1 was repeated except that the amount of the aromatic polyester resin was changed to 16 parts and 2 parts of 12-hydroxystearic acid was further added, whereby three thermal recording materials were formed.

Recording properties of the three thermal recording materials prepared in the above Examples and Comparative Examples were evaluated using a thermal transfer printer, Model FX P-6 of Fuji Xerox Co., Ltd. The results are shown in the following table.

TABLE

| | Comp. Ex. 1 | Comp. Ex. 2 | Comp. Ex. 3 | Ex. 1 | Ex. 2 |
|---|---|---|---|---|---|
| Sensitivity (mJ/dot) | <0.9 | ≧1.2 | ≧1.2 | <0.9 | <0.9 |
| Resolution of transfer image | Moderate | Moderate | Moderate | Good | Good |
| Fixability of transfer image | " | Good | Good | " | " |
| Transparency after transfer | Poor | " | " | " | " |
| Gloss of transfer image | " | " | " | " | " |
| Color mixing on transfer image | " | " | " | " | " |

The respective parameters were evaluated by the following methods.

Sensitivity: Recording sensitivity was evaluated in terms of the energy (E) that had to be applied to the thermal head for recording transfer dots equivalent to the size of each of the heating elements on the head ($\frac{1}{8}$ mm).

Resolution: The resolution of transfer image was evaluated in terms of the legibility of Chinese characters, particularly ones with many strokes.

Fixability: The fixability of transfer image was evaluated by rubbing the copy with a finger or a rubber eraser to check for any separation of ink layers or any soiling of the area around the transfer image.

Transparency: The transparency of transfer image was evaluated by projecting an overhead projector (OHP) sheet wih the transfer image onto a screen and checking for any color contamination.

Gloss: The gloss of the transfer image was evaluated visually.

Color mixing: The transfer image which was formed on coated paper superimposing two color images using two thermal recording materials was visually compared with a relevant Munsell standard color chip.

In the sample of Comparative Example 1 using wax as a binder, an image of each color was recorded with an applied energy which was about 80% and 90% of the energies required in the samples of Example 1 and Example 2, respectively. Thus the sample of Comparative Example 1 was slightly superior to the samples of Examples 1 and 2. However, some of the Chinese characters of many strokes which were recorded using the sample of Comparative Example 1 were defaced and hard to read. In addition, when the transfer image was rubber with a finger, the area around the image was soiled. The recording sensitivity of the samples of Examples 1 and 2 were comparable to that of the wax-type sample (Comp. Ex. 1); the printed characters were sharp and did not have any defaced or scratchy portions; and the transfer image could be rubbed hard without experiencing any separation of ink layers or soiling of the area around the image areas. In addition to these excellent recording characteristics, the samples of Examples 1 and 2 produced a projected image having uncontaminated and sharp colors. On the other hand, the wax-type sample produced only an dark and dull projected image with respect to magenta, cyan and yellow colors, respectively. This difference in transparency was most pronounced in the yellow ink. The wax-type sample had a diffused light transmittance of 10.5% at 700 nm where the pigment absorption was substantially zero, while the samples of Examples 1 and 2 had a transmittance of only 2.3%. This fact indicates the high transparency of the image on the samples of Examples 1 and 2 which permit only a very small amount of light to diffuse. The transfer image obtained from the wax-type sample had a glaring surface gloss which was characteristic of wax, but the samples of Example 1 and 2 produced transfer images having a uniform and smooth surface glass. In terms of color mixing, the wax-type sample produced only 2-color (cyan, magent, yellow) which was strongly influenced by each overlying color. However, the samples of Examples 1 and 2 having superior characteristics which were closer to those of the process inks employed in conventional printing techniques produced more brilliant red, green and blue as the 2-color (cyan, magent, yellow) colors. Comparison with the Munsell standard color chips showed that the cyan, magenta and yellow primary colors obtained from the wax-type sample and the samples of Examples 1 and 2 were substantially the same as the standard colors with respect to hue and brightness but that the primary colors on the samples of Examples 1 and 2 were clearly superior in terms of chroma. The results were almost the same with respect to the 2-color (cyan, magent, yellow) although there were slight mismatches in hue with the Munsell standard color chips.

The recording properties of the samples of Comparative Examples 2 and 3 were similar to that of the samples of Examples 1 and 2 with respect to the fixability of transfer image, transparency, gloss and color mixing. However, the comparative samples were quite inferior to the wax-type sample in terms of recording sensitivity. It also exhibited low resolution as evidenced by failure to reproduce fine details like dots in Chinese characters.

EXAMPLE 3

A black ink composition was prepared as in Example 1 except that carbon black was used as a colorant. A thermal recording material was prepared using this ink composition and its properties were evaluated. The energy (E: about 0.8 mJ/dot) that had to be applied to the thermal head for recording was about 1.3 times the energy required for recording with the wax-type sample (Comp. Ex. 1). The transfer image obtained had adequate fixability and produced sharp characters which had neither defaced nor scratcy portions.

EXAMPLE 4

A black ink compositions was prepared as in Example 2 except that carbon black was used as a colorant. A thermal recording material was prepared using this ink composition and its properties were evaluated. The energy (E: about 0.7 mJ/dot) that had to be applied to the thermal head for recording was about 1.1 times the energy required for recording with the wax-type sample. The transfer image obtained had adequate fixability and produced sharp characters which had neither defaced or scratcy portions.

EXAMPLE 5

Cyan, magenta and yellow ink compositions were prepared as in Example 1 except that the colorants for the respective inks were a blue dye (C.I. Solvent Blue 180), a red dye (C.I. Solvent Red 52) and a yellow dye (C.I. Solvent Yellow 77). Thermal recording materials were prepared using these ink compositions and their recording properties were evaluated: The images obtained were excellent in terms of transparency and color mixing and produced tenacious characters which had neigher defaced nor scratcy portions.

EXAMPLE 6

The components shown below were mixed and dispersed with an attritor to formulate a heat-sensitive ink material.

| | |
|---|---|
| Aromatic polyester resin 1 (same as used in Example 1) | 18 parts |
| Partially crosslinked aromatic polyester resin 2 (Mn: about 5,000; Tg: about 70° C.; produced by reacting trimellitic acid (1), phthalic acid (1) and alkenyl-substituted succinic acid (1) as the acid components with the reaction product of bisphenol A (1) and propylene glycol (1) (mol ratio in "( )")) | 9 parts |
| Colorant (carbon black) | 3 parts |

-continued

| | |
|---|---|
| Toluene | 35 parts |
| Methyl ethyl ketone | 35 parts |

The ink material was applied with a gravure coater onto a plyimide film (7.5 microns thick) to form a heat-sensitive ink layer having a dry thickness of 3.5 microns. Using the thus prepared thermal recording material, characters were printed with a thermal transfer printer equipped with a thermal head having heating elements at a density of 8 dots/mm (average resistance of the the heating elements=350 ohms). Transfer images characterized by faithful halftone reproduction were obtained; the density of printed characters varied continuously from 0.01 to 1.40 when the energy applied to the thermal head changed from 0.5 mJ/dot to 1.2 mJ/dot.

EXAMPLE 7

Heat-sensitive ink materials 1 and 2 were formulated by mixing and dispersing the components shown below with an attritor.

Heat-sensitive ink material 1:

| | |
|---|---|
| Aromatic polyester resin 1 (same as used in Example 1) | 28 parts |
| Colorant (carbon black) | 2 parts |
| Toluene | 35 parts |
| Methyl ethyl ketone | 35 parts |

Heat-sensitive ink material 2:

| | |
|---|---|
| Aromatic polyester resin 2 (same as aromatic polyester resin 2 used in Example 6) | 25.5 parts |
| Colorant (carbon black) | 4.5 parts |
| Toluene | 35 parts |
| Methyl ethyl ketone | 35 parts |

The ink materials 1 and 2 were applied with a gravure coater onto a polyimide film (7.5 microns thick) in the order of materials 1 and 2 to form two heat-sensitive layers each having a dry thickness of 2 microns. Using the thus prepared thermal recording material, characters were printed with a thermal transfer printer of the same type as used in Example 6. The recording material was found to have three-level printing characteristics which were capable of consistently producing a printing density which were about half the saturation density (maximum optical density: about 1.4).

EXAMPLE 8

The components shown below were mixed and dispersed with an attritor to formulate a heat-sensitive ink material.

| | |
|---|---|
| Aromatic polyester resin (same as used in Example 1) | 21 parts |
| Fatty acid amide (m.p. 72.5 ± 2.5° C.; "Shibosan Amide-O" produced by Kao Co., Ltd.) | 3 parts |
| Paraffin wax (m.p. 69° C.; "Paraffin 155" produced by Nippon Seiro Co., Ltd.; crystalline wax) | 3 parts |
| Colorant (carbon black) | 3 parts |
| Toluene | 70 parts |

The ink material thus prepared was applied with a gravure coater onto a polyester film (6 microns thick) to form a heat-sensitive ink layer having a coating weight of 3.5 g/m$^2$ on a dry basis.

RThe resulting thermal recording material was evaluated by the same methods as used in Example 1; it had a recording sensitivity comparable to that of the wax-type sample and provided strongly fixed printed characters which had sharp contours and were free from any defaced or sratchy portions.

EXAMPLE 9

The components shown below were mixed and dispersed with an attritor to formulate a heat-sensitive ink material.

| | |
|---|---|
| Aromatic polyester resin 1 (same as used in Example 1) | 16 parts |
| Partially crosslinked aromatic polyester resin 2 (same as used in Example 6) | 8 parts |
| Fatty acid amide (same as used in Example 8) | 2 parts |
| Ester wax (m.p. 98° C.; "Kao-Wax 230-Z" produced by Kao Co, Ltd.) | 1 part |
| Colorant (carbon black) | 3 parts |
| Toluene | 35 parts |
| Methyl ethyl ketone | 35 parts |

The ink material was applied with a gravure coater onto a polyimide film (7.5 microns thick) to form a heat-sensitive ink layer having a dry thickness of 3.5 microns. Using the thus prepared thermal recording material, characters were printed with a thermal transfer printed as used in Example 6. Transfer images characterized by faithful halftone reproduction were obtained; the density of printed characters varied continuously from 0.01 to 1.40 when the energy applied to the thermal head changed from 0.4 mJ/dot to 0.9 mJ/dot.

As is clearly seen from the above Examples and Comparative Examples the thermal recording material of the present invention produces a color image having good reproduction, high recording sensitivity, transferability, fixability and resolution on the receiving sheet.

The thermal recording material using the amrophous polyester as a binder has the advantage that the light scattering which has been encountered in the use of crystalline wax as a binder is either eliminated or reduced to a substantially negligible level. Therefore, the binder layer in the thermal recording material of the present invention retains a very high degree of transparency.

In order to obtain sharp color images, especially pictorial full color reproduced images, 2- or 3-color (cyan, magent, yellow) may be produced by superimposing layers of magenta, yellow and cyan ink materials. In this case, if the heat-sensitive ink material of the present invention is used to form at least the uppermost layer, its high transparency allows the underlying ink layer to yield reflected light having characteristics which are close to those of the pigment used in that layer, and the colors obtained are in no way different from the desired 2- or 3-color.

The amorphous polyester resin used in the present invention usually has —COOH and —OH groups at the terminal ends of the molecular chain. These functional groups provide hydrogen bonds on the support for the heat-sensitive ink material or on the receiving sheet. The hydrogen bonds make great contribution in two ways: they improve the film-forming ability of the ink material on the support and, secondly, they provide better transferability of thermal images onto the receiving sheet. In addition, the transfer image obtained from the ink material using the amorphous polyester has better fixability than when the conventional low-melting point crystalline wax is used as a binder.

The mild melting characteristics of the amorphous polyester allow the ink material to be supplied to the receiving sheet in an amount which corresponds to the energy applied to the heat-sensitive ink material and this is effective in attaining faithful reproduction of continuous tone in transfer images. Furthermore, the releasing agent added in a predetermined amount helps to prevent the development of an excessively great adhesive or cohesive strength at the interface between the amorphous polyester and the support without causing substantial decrease in the transparency of the amorphous polyester and, as a result, the thermal recording material of the present invention features high recording sensitivity and image resolution.

While the invention has been described in detail and with reference to specific embodiments thereof, it will be apparent to one skilled in the art that various changes and modifications can be made therein without departing from the spirit and scope thereof.

What is claimed is:

1. A heat-sensitive hot-melt transfer image recording material comprising a support and a transfer layer which comprises an amorphous polyester having a glass transition temperature of from about 50° C. to 80° C. and a number average molecular weight of not more than about 5,000 and a weight average molecular weight of not more than about 10,000 and a coloring material as main components, said amorphous polyester being present in an amount of at least 50% by volume based on solid components of the transfer layer.

2. A image recording material as in claim 1, wherein said amorphous polyester has a bisphenolic component in the main chain.

3. An image recording material as claimed in claim 2, wherein said bisphenolic component is selected from the group represented by formulae 1–15

(1)

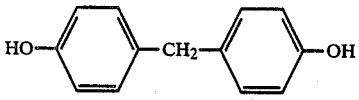

(2)

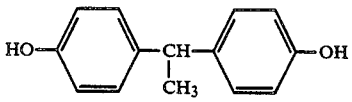

(3)

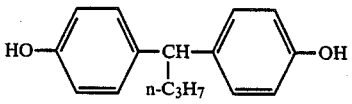

(4)

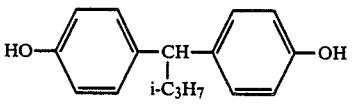

(5)

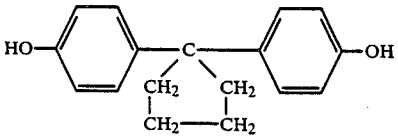

-continued (6)

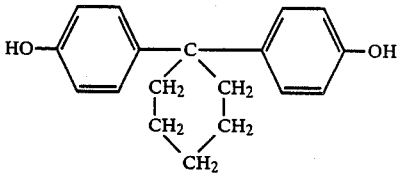

(7)

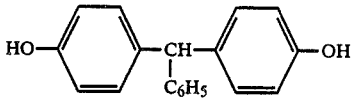

(8)

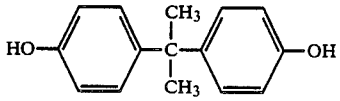

(9)

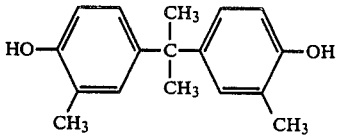

(10)

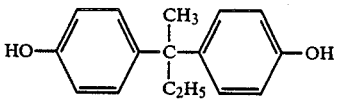

(11)

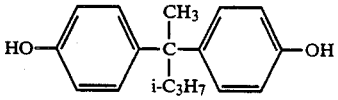

(12)

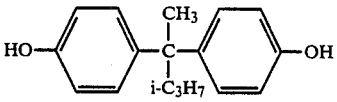

(13)

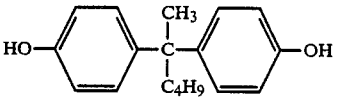

(14)

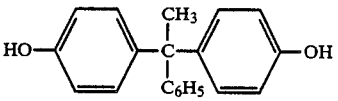

(15)

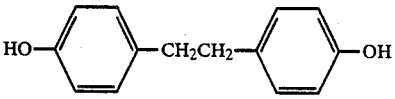

4. A image recording material as in claim 1, wherein said amorphous polyester is present in an amount of at least 70% by volume based on solid components of the transfer layer.

5. A image recording material as in claim 1, wherein said transfer layer further comprises a releasing agent.

6. A image recording material as in claim 5, wherein the volume ratio of the amorphous polyester to the releasing agent is from about 70/30 to about 99/1.

7. A image recording material as in claim 6, wherein said volume ratio is from about 80/20 to about 95/5.

8. A image recording material as in claim 5, wherein said releasing agent has a melting point or softening point of from 50° to 200° C.

9. A image recording material as in claim 8, wherein said releasing agent has a melting point or softening point of from 60° to 150° C.

10. A image recording material as in claim 5, wherein said releasing agent has such a low viscosity that the melt viscosity suddenly decreases to about 10 poises or less in a temperature range of from about 100° to about 180° C. and/or such a low surface energy as having a critical surface tension of about 40 dyn/cm or less.

11. A image recording material as in claim 1, wherein a layer of a parting agent is provided between the support and the transfer layer.

12. A image recording material as in claim 1, wherein said support is an electrically resistant support.

13. A image recording material as in claim 12, wherein said electrically resistant support comprises a binder resin and an electrical conductor.

14. An image recording material as in claim 1, wherein said amorphous polyester is prepared using, as an acidic component, a dibasic acid selected from the group consisting of phthalic acid, phthalic anhydride, isophthalic acid, terephthalic acid, hexahydrophthalic anhydride, malonic acid, succinic acid, glutaric acid, adipic acid, sebacic acid, maleic anhydride, fumaric acid, itaconic acid and tetrahydrophthalic anhydride or a dimer acid selected from the group consisting of linolic acid.

15. An image recording material as in claim 1, wherein said amorphous polyester is a branched or cross-linked polyester prepared using a trifunctional compound selected from the group consisting of trimellitic acid, glycerin, and trimethylolpropane.

* * * * *